US006109858A

United States Patent [19]

Deneve et al.

[11] Patent Number: 6,109,858

[45] Date of Patent: Aug. 29, 2000

[54] IMPLEMENT LIFT ARM ARRANGEMENT FOR A SKID STEER LOADER

[75] Inventors: Jeffrey A. Deneve, Sanford; Rodney D. McLamb, Cary, both of N.C.; Matthew P. Rosefsky, Haverford, Pa.

[73] Assignee: Caterpillar Inc., Peoria, Ill.

[21] Appl. No.: 09/092,810

[22] Filed: Jun. 5, 1998

[51] Int. Cl.[7] ..... E02F 3/30

[52] U.S. Cl. ..... 414/685; 414/697

[58] Field of Search ..... 414/680, 685, 414/697, 715

[56] References Cited

U.S. PATENT DOCUMENTS

| | | | |
|---|---|---|---|
| D. 314,389 | 2/1991 | Lynnes et al. | D15/25 |
| D. 317,926 | 7/1991 | Lynnes et al. | D15/25 |
| 3,828,952 | 8/1974 | Klee . | |
| 4,364,705 | 12/1982 | Shumaker | 414/713 |
| 4,705,449 | 11/1987 | Christianson et al. | 414/685 |
| 4,903,418 | 2/1990 | Loudon | 414/685 |
| 4,973,214 | 11/1990 | Schupback et al. | 414/727 |
| 5,169,277 | 12/1992 | Orser et al. | 414/685 |
| 5,169,278 | 12/1992 | Hoechst et al. | 414/685 |
| 5,511,932 | 4/1996 | Todd et al. | 414/685 |
| 5,542,814 | 8/1996 | Ashcroft et al. | 414/786 |
| 5,609,464 | 3/1997 | Moffitt et al. | 414/685 |

FOREIGN PATENT DOCUMENTS

| | | |
|---|---|---|
| 2241686 | 9/1991 | United Kingdom . |
| 2278826 | 12/1994 | United Kingdom . |
| 2291384 | 1/1996 | United Kingdom . |

OTHER PUBLICATIONS

Chart prepared for purposes of this IDS listing various physical ratio of prior art skid steer loaders.

*Primary Examiner*—Gregory A. Morse
*Attorney, Agent, or Firm*—John J. Cheek

[57] ABSTRACT

A skid steer loader has at least one or a pair of implement lift arm assemblies pivotally connected with a body of the loader. The lift arms, their associated lift actuators, and the connections between the various components of the lift arm assemblies and the machine implement are configured to provide increased dump reach without negatively impacting structural life, to increase machine productivity by reduced cycle times, and to improve visibility of the implement from the operator's station.

1 Claim, 2 Drawing Sheets

IMPLEMENT LIFT ARM ARRANGEMENT FOR A SKID STEER LOADER

TECHNICAL FIELD

This invention relates to a skid steer loader and, more particularly, to an implement lift arm arrangement for a skid steer loader.

BACKGROUND ART

Skid steer loaders are well known in the art and typically comprise a body having skid-steer drive means mounted thereto. The drive means may be either front and rear pairs of driven wheels, left and right endless tracks, or front and rear pairs of wheels having rubber belts or steel tracks therearound to simulate endless tracks. Typically, the loaders have left and right interconnected lift arms pivotally mounted to respective tower portions of the body near the rear of the loader, and an implement, such as a bucket for example, is attached at the forward ends of the lift arms. Hydraulic lift actuators or the like are connected between the body and the lift arm to raise and lower the lift arms, and one or more hydraulic actuators are connected between the lift arms and the implement to tilt the implement relative to the lift arms.

Skid steer loaders, in many applications, are used to load material into dump trucks, wagons, or other containers. In this application, current skid steer loader lift arm arrangements require the loader be practically abutted with the container in order for a load to be dumped into the container. Such loading conditions are problematic. Increased dump reach which avoids the need to abut the loader with the container can be achieved by moving the pivot point of the lift arm near the forward end of the loader, but such location of the lift arms may lead to machine instability and undesirable loading of the machine body.

Other problems faced in the use of skid steer loaders relate to machine productivity as it is impacted by the cycle times needed to move the implement to various locations and orientations relative to the loader body and the need for good operator forward visibility without locating components in interference with the body or other parts of the machine.

This invention is directed to solving one or more of the aforementioned problems.

DISCLOSURE OF THE INVENTION

A skid steer loader in accordance with this invention comprises a body having left and right upright tower portions and front and rear coaxial, horizontally-spaced pairs of drive wheels mounted to the body. Each wheel, in side elevation, has a center which lies along a first common imaginary straight line, and the tower portions of the body are located rearward of the centers of the rear wheels. The distance between the front and rear wheel centers defines a wheel base.

The loader further includes left and right interconnected lift arm assemblies each comprising an implement lift arm and a lift actuator. Each implement lift arm is pivotally connected with the corresponding tower portion of the body at a lift arm pivot point located a first horizontal distance rearward of the centers of the front wheels. The ratio of the first distance to the wheel base is in the range of about 1.00 to about 1.50 inclusive. Each lift actuator is connected between the body and the lift arm. The lift actuator is connected with the lift arm at a fixed second distance from the lift arm pivot point and is connected with the corresponding tower portion of the body elevationally higher than the rear wheels at a lift actuator pivot point. The lift actuator pivot point is spaced (a) a third distance from the lift arm pivot point, (b) a fourth horizontal distance rearward of the centers of the front wheels, and (c) a fifth vertical distance above the first imaginary straight line.

The ratio of the second distance to the wheel base is equal to or less than about 1.25, the ratio of the third distance to the wheel base is equal to or less than about 0.59, the ratio of the third distance to the fourth distance is equal to or less than about 0.45, and the ratio of the third distance to the fifth distance is equal to or less than about 1.00.

An implement is pivotally connected with the lift arm assemblies about an implement pivot axis located at a fixed sixth distance from the lift arm pivot points. In side elevation, the lift arm pivot point and the implement axis lie along a second common imaginary straight line. The ratio of the second distance to the sixth distance is equal to or less than about 0.52. The implement may be directly connected to the lift arm assemblies or it may be releasably-connected to a coupler assembly that is pivotally connected with the lift arm assemblies.

At least one implement tilt actuator is connected between at least one of the lift arm assemblies and the implement. The tilt actuator is connected with the implement at a location spaced a seventh distance from the implement pivot axis and is connected with the at least one lift arm assembly at a location spaced an eighth perpendicular distance from the second imaginary straight line. The ratio of the eighth distance to the seventh distance is in the range of about 2.20 to about 2.65 inclusive. The connection of the tilt actuator with the at least one lift arm assembly is also at a location spaced a ninth distance from the implement pivot axis. A projection of the ninth distance upon the imaginary straight line connecting the lift arm pivot point and the implement pivot axis extends a tenth distance from the implement pivot axis, and the ratio of the tenth distance to the seventh distance is equal to or greater than about 3.66.

Other features of this invention will be apparent from the following description and accompanying drawings.

BRIEF DESCRIPTION OF THE DRAWINGS

FIG. 1 shows the loader with its implement lift arms in a lowered position.

BEST MODE FOR CARRYING OUT THE INVENTION

Figure 1:
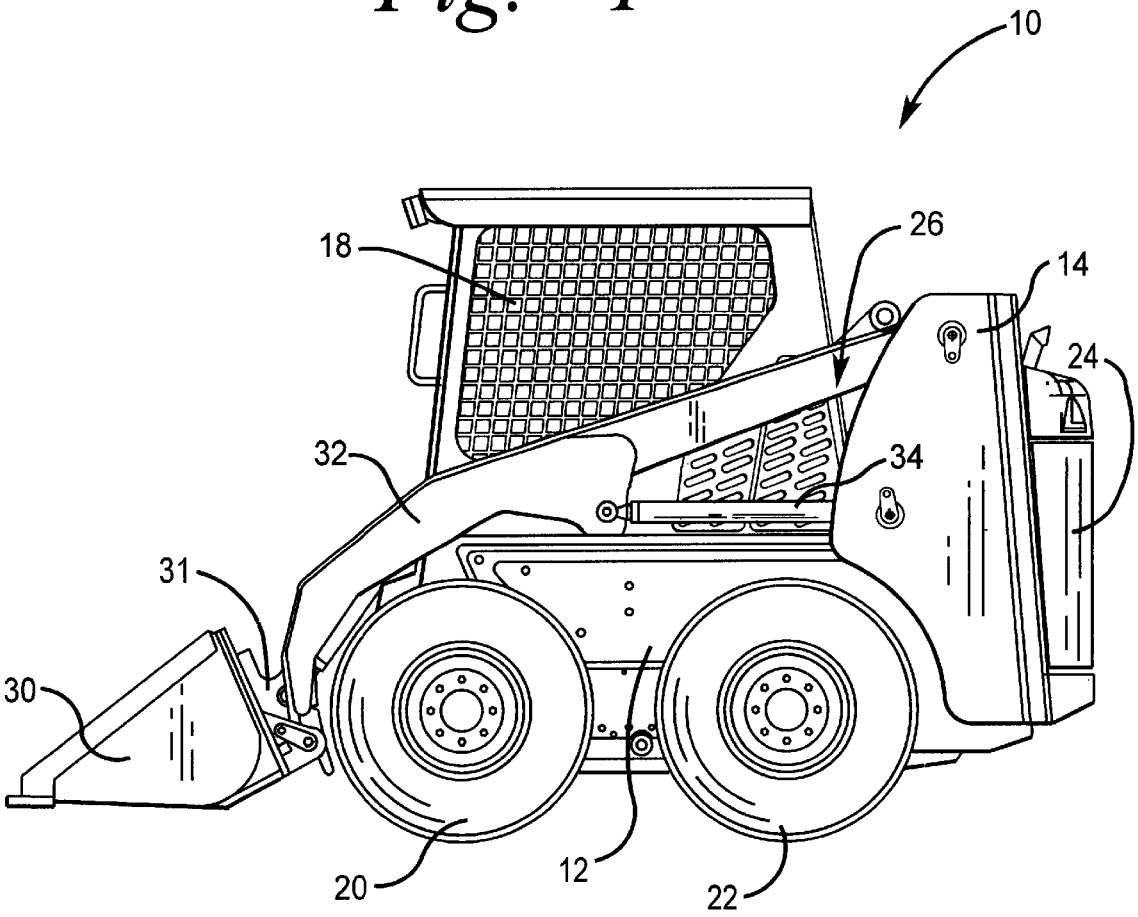
FIG. 1 is a side elevational view of a skid steer loader in accordance with this invention.
Figure 2:
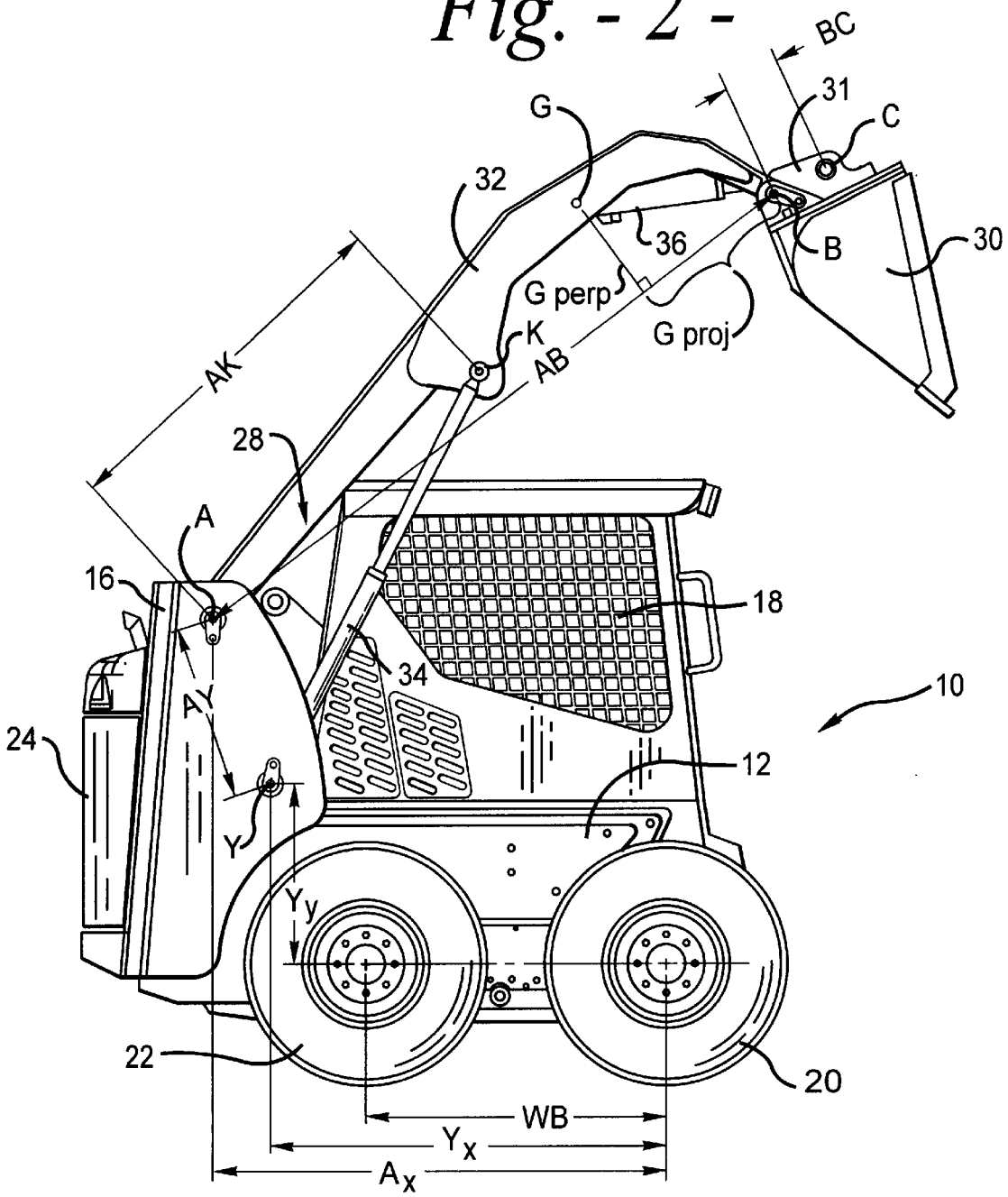
FIG. 2 is a side elevational view similar to FIG. 1 but showing the loader facing in the opposite direction and the implement lift arms in a raised position.

With reference to the drawings, a skid steer loader, generally designated 10, in accordance with this invention comprises a body 12 having left and right upright stanchions or tower portions 14, 16 and an operator's station, generally designated 18. Front and rear pairs of coaxial drive wheels 20, 22 are mounted to the body 12 and powered by an engine (not shown) which is mounted to the body 12 rearward of the operator's station 18 in a rear engine enclosure 24. As best shown in FIG. 2, the horizontal distance between the centers of front and rear wheels 20, 22 on each side of the loader 10 define a wheel base WB.

The drive wheels 20, 22 may be driven in a conventional, skid-steer fashion which is well known in the art and not described further herein. However, one skilled in the art will recognize that the drive wheels 20, 22 may be replaced by left and right endless belts or track assemblies (not shown) or may be used to simulate belts or tracks (not shown) by driving rubber belts or steel tracks looped therearound.

Left and right interconnected lift arm assemblies 26, 28 are mounted to the body 12 and have an implement assembly, such as a bucket 30, pivotally mounted at the forward ends thereof. In the illustrated loader 10, the implement assembly includes a coupler assembly 31 to which the bucket 30 or other implement is attached, and the coupler assembly 31 itself is pivotally connected with the lift arm assemblies 26, 28. The lift arm assemblies 26, 28 may be substantially identical to each other, so only the right side lift arm assembly 28 is discussed in further detail herein. The lift arm assembly 28 comprises a lift arm 32 pivotally connected with the right tower portion 16 of the body 12 at a lift arm pivot point A, which is spaced a fixed distance $A_x$ rearward of the center of the front drive wheel 20. The ratio of the distance $A_x$ to the wheel base WB is preferably in the range of about 1.00 to about 1.50 inclusive.

It will be noted that the distance $A_x$ is typically fixed during operation of the loader 10, but each front and rear wheel 20, 22 may be adjustable fore and aft on the order of ¼" to permit proper tensioning of the belts or chains (not shown) which transmit power to the wheels 20, 22. The ratios discussed herein relative to the wheel base WB are based on the nominal wheel base of a machine which permits minor fore and aft adjustment of the front and rear wheels 20, 22. Any deviations from the disclosed ratios as a result of machine adjustments over time are intended to be encompassed by this invention.

Referring particularly to FIG. 2, the lift arm 32 is pivoted relative to the body 12 to lift the bucket 30 or other implement by means of a lift actuator 34, which may be a conventional hydraulic or pneumatic cylinder or other linear acting actuator. The lift actuator 34 is connected at one end to the tower portion 16 of the body 12 at a point Y located above the rear drive wheels 22 and spaced a fixed distance AY from the lift arm pivot point A and a fixed distance $Y_x$ rearward of the center of the front wheel 20. The point Y is also spaced a fixed distance $Y_y$ above an imaginary line joining the centers of the front and rear wheels 20, 22. The lift actuator 34 is connected at its opposite end with the lift arm 32 at a point K spaced a fixed distance AK from the lift arm pivot point A. The ratio of the distance AK to the wheel base WB is preferably less than or equal to about 1.25, whereas the ratio of the distance AY to the wheel base WB is less than or equal to about 0.59. The ratios of the distance AY to $Y_x$ and $Y_y$, respectively, are preferably less than or equal to about 0.45 and 1.00, respectively.

With continued reference to FIG. 2, the bucket 30 is pivotally mounted to the forward end of the lift arm 32 about a pivot axis B, which is spaced a fixed distance AB from the lift arm pivot point A. The ratio of the distance AK to the distance AB is preferably less than or equal to about 0.52. The bucket 30 is pivoted relative to the lift arm 32 by way of one or more tilt actuators 36, which may be a hydraulic, pneumatic or other linear acting actuator, connected between the lift arm 32 and the coupler assembly 31, as shown, or bucket 30 in the case of a non-removable implement. The tilt actuator 36 is connected at one end to the lift arm 32 at a point G on the lift arm 32 and at its opposite end to a point C on the coupler 31 or the bucket 30 as the case may be. The point C on the coupler 31 is spaced a fixed distance BC from the pivot axis B of the bucket 30 and coupler 31.

The point G is spaced a fixed perpendicular distance $G_{perp}$ from an imaginary straight line A-B joining the lift arm pivot point A and the bucket pivot axis B. The ratio of the distance $G_{perp}$ to the distance BC is preferably in the range of about 2.20 to about 2.65 inclusive. The point G is also spaced a fixed distance GB from the bucket pivot axis B. A projection of the distance GB onto the aforementioned imaginary straight line A-B has a length $G_{proj}$, and the ratio of the length $G_{proj}$ to the distance BC is preferably greater than or equal to about 3.66.

For skid steer loaders having rated operating capacities in the ranges of 1350 pounds to 1500 pounds and 1750 pounds to 1900 pounds, respectively, the following ratios are preferred:

| Ratio | 1350–1500 lbs | 1750–1900 lbs |
|---|---|---|
| $A_x$/WB | 1.472 | 1.486 |
| AK/WB | 1.198 | 1.195 |
| AK/AB | 0.514 | 0.516 |
| AY/WB | 0.583 | 0.550 |
| AY/$Y_x$ | 0.448 | 0.419 |
| AY/$Y_y$ | 1.000 | 0.932 |
| $G_{perp}$/BC | 2.630 | 2.282 |
| $G_{proj}$/BC | 3.669 | 3.689 |

Of course, the particular ratios set forth in the table above are not intended to be limiting and may be applicable to loaders having different rated operating capacities.

INDUSTRIAL APPLICABILITY

The configuration of the lift arm assemblies 26, 28 described above, including the particulars of the interconnections between the components thereof, provides various advantages over previously known skid steer loader lift arm arrangements. For example, by limiting the ratio of the distance $A_x$ to the wheel base WB as described above, increased dump reach is obtained while shortening the load path from the bucket 30 to the rear wheels 22 of the loader, thereby improving structural life, and avoiding machine instability. Similarly, limiting each of the ratios AK/WB, AK/AB, AY/WB, AY/$Y_x$, and AY/$Y_y$ as described above, either together or alone, reduces lift actuator travel to thereby produce faster cycle times than previously known in the art. Operator visibility is also improved without creating an undesirable interference between the tilt actuators 36 and the body 12 by configuring the lift arm assemblies 26, 28 such that the ratios of $G_{perp}$/BC and $G_{proj}$/BC are as described above.

Although the presently preferred embodiments of this invention have been described, it will be understood that within the purview of the invention various changes may be made within the scope of the following claims.

What is claimed is:

1. A skid steer loader, comprising:

a body having left and right upright tower portions;

front and rear horizontally-spaced, coaxial pairs of drive wheels mounted to said body, the front and rear wheels in side elevation having centers lying along a first common imaginary straight line, the distance between said wheel centers defining a wheel base and the tower portions of said body being located rearward of the centers of said rear wheels;

left and right interconnected lift arm assemblies each comprising:

an implement lift arm pivotally connected with the corresponding tower portion of said body at a lift arm pivot point located a first horizontal distance rearward of the centers of said front wheels, the ratio of said first distance to said wheel base being in the range of about 1.00 to about 1.50 inclusive, and a lift actuator connected between said body and said lift arm, said lift actuator being connected with said lift arm at a fixed second distance from said lift arm pivot point and connected with the tower portion of said body elevationally higher than said rear wheel at a lift actuator pivot point spaced (a) a third distance from said lift arm pivot point, (b) a fourth horizontal distance rearward of the center of said front wheels, and (c) a fifth vertical distance above said first imaginary straight line, the ratio of said second distance to said wheel base being equal to or less than about 1.25, the ratio of said third distance to said wheel base being equal to or less than about 0.59, the ratio of said third distance to said fourth distance being equal to or less than about 0.45, and the ratio of said third distance to said fifth distance being equal to or less than about 1.00;

an implement pivotally connected with said lift arm assemblies about an implement pivot axis located at a fixed sixth distance from said lift arm pivot points, the ratio of said second distance to said sixth distance being equal to or less than about 0.52, said lift arm pivot point and said implement axis in side elevation lying along a second common imaginary straight line; and at least one implement tilt actuator connected between at least one of said lift arm assemblies and said implement, said tilt actuator being connected with said implement at a location spaced a seventh distance from said implement pivot axis and being connected with said at least one lift arm assembly at a location spaced an eighth perpendicular distance from said second imaginary straight line, the ratio of said eighth distance to said seventh distance being in the range of about 2.20 to about 2.65 inclusive, said connection of said tilt actuator with said at least one lift arm assembly horizontally-spaced further being at a location spaced a ninth distance from said implement pivot axis, a projection of said ninth distance upon said imaginary straight line connecting said lift arm pivot point and said implement pivot axis extending a tenth distance from said implement pivot axis, the ratio of said tenth distance to said seventh distance being equal to or greater than about 3.66.

* * * * *